United States Patent [19]

Juzi

[11] Patent Number: 4,650,503

[45] Date of Patent: Mar. 17, 1987

[54] PHASE DISTRIBUTION TANK

[75] Inventor: Heinz Juzi, Andelfingen, Switzerland

[73] Assignee: Sulzer Brothers Limited, Winterthur, Switzerland

[21] Appl. No.: 824,719

[22] Filed: Jan. 31, 1986

Related U.S. Application Data

[63] Continuation of Ser. No. 650,223, Sep. 13, 1984, abandoned.

[30] Foreign Application Priority Data

Sep. 22, 1983 [CH] Switzerland ..... 5149/83

[51] Int. Cl.[4] ..... B01D 19/00

[52] U.S. Cl. ..... 55/185; 55/419; 55/465; 122/488

[58] Field of Search ..... 55/185–188, 55/206, 207, 419, 462, 464, 465; 210/188; 122/34, 488

[56] References Cited

U.S. PATENT DOCUMENTS

| | | | |
|---|---|---|---|
| 2,151,863 | 3/1939 | Millard | 55/185 |
| 2,321,628 | 6/1943 | Rowand et al. | 55/185 X |
| 2,595,602 | 5/1952 | Parks | 55/186 X |
| 3,547,085 | 12/1970 | Kovacik et al. | 55/465 X |
| 3,593,500 | 7/1971 | Ritland et al. | 122/488 X |
| 4,019,881 | 4/1977 | Herzog et al. | 55/185 |
| 4,214,883 | 7/1980 | Raseley et al. | 55/185 X |
| 4,278,053 | 7/1981 | Bessouat et al. | 122/488 |
| 4,305,548 | 12/1981 | Miner et al. | 55/465 X |
| 4,429,662 | 2/1984 | Hashizume et al. | 122/34 X |

FOREIGN PATENT DOCUMENTS

| | | | |
|---|---|---|---|
| 2917389 | 11/1979 | Fed. Rep. of Germany | 55/185 |

*Primary Examiner*—Charles Hart

*Attorney, Agent, or Firm*—Kenyon & Kenyon

[57] ABSTRACT

The phase distribution tank is provided with a partition which separates an inlet chamber from an outlet chamber. The partition has a gas phase passage at the upper end and liquid phase passages at the lower end. The discharge conduit for the liquid phase is disposed so that the liquid level in the outlet chamber is within the plane of the orifice of the discharge conduit so that both gas and liquid may discharge.

3 Claims, 11 Drawing Figures

PHASE DISTRIBUTION TANK

This is a continuation of application Ser. No. 650,223 filed Sept. 13, 1984 and now abandoned.

This invention relates to a phase distribution tank.

As is known, various types of phase distribution tanks have been used for various purposes. In many cases, these tanks have been constructed of horizontal tubes into which a number of feed conduits feed while an equal or different number of discharge conduits discharge. The object of such a tank is to uniformly distribute phases of a two-phase mixture which is delivered to the tank so that the phases are of equal proportion in all the discharge conduits and remain constant for a constant state of operation irrespective of whether different phase distributions occur between the individual feed conduits and/or in the feed conduits due to variations per unit of time.

As is also known, different phase distributions occur in the distribution tank for various reasons. For example, in a relatively large interior of the tank, the speed of the mixture may drop to a relatively low value. As a result, the flow is quieted and a separation of the mixed phases occurs mainly due to the different specific gravities. Further, the surface of the relatively quiet liquid phase usually forms a level which intersects the orifice of a discharge conduit. Thus, in the region of this orifice the gaseous phase flows faster than the quieted liquid phase because the liquid phase is more viscous and dense than the gaseous phase. Hence, the liquid phase is partially entrained by the gaseous phase. As a result, the discharge orifice acts like a jet pump.

Given a constant level and pressure conditions between the interior of a tank and the discharge conduit, the amount of entrained liquid can be made constant and can be determined by appropriate design of the components concerned. The proportion of the phases in the departing mixture can therefore be controlled and kept constant even if there is a different number of feed conduits from the number of discharge conduits.

However, the known phase distribution tanks have two main disadvantages.

First, at high mixture inlet speeds, intensive turbulence occurs in the region of the orifice to the feed conduit and develops over the entire tank so that it is impossible to maintain a constant liquid level either per unit of time or along the tank.

Second, the relatively high pressure in the region of the orifice to the feed conduit and the lower pressure in the region of the orifice to the discharge conduit produce different liquid levels along the tank even at low mixture inlet speeds. Since there are usually a plurality of feed and/or discharge conduits, this state of affairs makes it impossible to maintain an equal phase distribution in all the discharge conduits.

Obviously, the serviceability of a phase distribution tank is seriously impaired by the disturbance to the liquid level in the region of the orifice to the discharge conduit and, in extreme cases, the tank may even be made completely unserviceable.

Additional disturbances are those due to the state of operation which can, in this case, be illustrated by reference to a steam generator for water/steam. The combustion chamber of a steam generator of this kind is, of course, preferably formed by vertical tubes through which water flows upwards and is heated by combustion gases inside the combustion chamber. Since the heat distribution inside the combustion chamber is not ideal, the heat absorption by the water is unequal in the various tubes and the water-steam mixture leaving the top end of the tubes has considerable differences in state. The mixture is therefore fed to phase distribution tanks in the form of headers, the object being to obtain a water-steam mixture of identical states in all the discharge conduits. In practice, however, considerable deviations from the required value are found.

Accordingly, it is an object of the invention to provide a phase distribution tank in which the level of liquid is maintained constant during operation.

It is another object of the invention to operate a phase distribution tank at optimum efficiency for any gasliquid mixture proportions.

It is another object of the invention to provide a gas phase distribution tank which can be manufactured at relatively low cost.

It is another object of the invention to provide a phase distribution tank for a water-steam mixture which may operate in all states of the water-steam mixture.

Briefly, the invention provides a phase distribution tank for a gas-liquid mixture which has at least one partition therein to separate an inlet chamber from an outlet chamber. In addition, at least one feed orifice is provided in the tank for a connection to a feed conduit for feeding a gasliquid mixture into the inlet chamber while at least one discharge orifice is provided for connection to a discharge conduit for discharging a gas-liquid mixture from the outlet chamber. Further, at least one gas passage aperture is provided in a top zone of the partition above the level of the discharge orifice for passage of the gas phase of the mixture from the inlet chamber to the outlet chamber while at least one liquid passage aperture is provided in a bottom zone of the partition below the level of the discharge orifice for passage of the liquid phase of the mixture from the inlet chamber to the outlet chamber.

The gas passage aperture and liquid passage aperture are so disposed in the partition so as to eliminate any effect of turbulence in the inlet chamber on the level of the liquid in the outlet chamber.

One advantage of the tank is that existing phase distribution tanks can be simply modified by the addition of at least one partition. Another advantage resides in the significant reinforcement of the tank by the partition, thus allowing lighter weight and cheaper methods of construction.

In one embodiment, the distribution tank is formed of a horizontally disposed tube. In this case, the partition may be formed as a trough within the tube. This provides for a very advantageous symmetrical arrangement of the feed and discharge conduits along the tank.

Alternatively, the partition may be in the form of a disc which is vertically disposed in perpendicular relation to a longitudinal axis of the tube. This construction enables the feed and discharge conduits to be separated from one another in groups along sections of the tube. This construction may be simply achieved by having a plurality of rods extend longitudinally within the tube with the disc mounted on the rods.

In order to promote rapid separation of the two phases, a feed conduit is connected to the feed orifice and is disposed on a vertical axis perpendicular to a longitudinal axis of the tube. In this case, the conventional separation of two phases of the mixture by gravity is additionally assisted by deflection of the incoming mixture at the bottom of the inlet chamber by a centrifugal force.

In another embodiment, the feed conduit and discharge conduit may each be connected on respective axes which are perpendicular to a longitudinal axis of the tube and which define an angle of more than 29° and less the 86°. This construction permits the manufacture of the tank to be more readily performed. In addition, a good arrangement of the orifices to the discharge conduits relative to the liquid level in the outlet chamber is obtained.

Each discharge orifice of the tank may be of rectangular shape with a pair of horizontal sides. Such a configuration results in the liquid surface exposed to the outgoing gas being constant at all levels. Thus, the amount of liquid entrained by the gas remains substantially constant in response to small differences in liquid level.

These and other objects and advantages of the invention will become more apparent from the following detailed description taken in conjunction with the accompanying drawings wherein:

FIG. 1 illustrates a pressure-enthalpy diagram for water/steam showing a number of working zones;

FIG. 2 graphically illustrates a deviation of a relative water flow against a relative air flow of a prior art construction and a phase distribution tank according to the invention;

Figure 1:
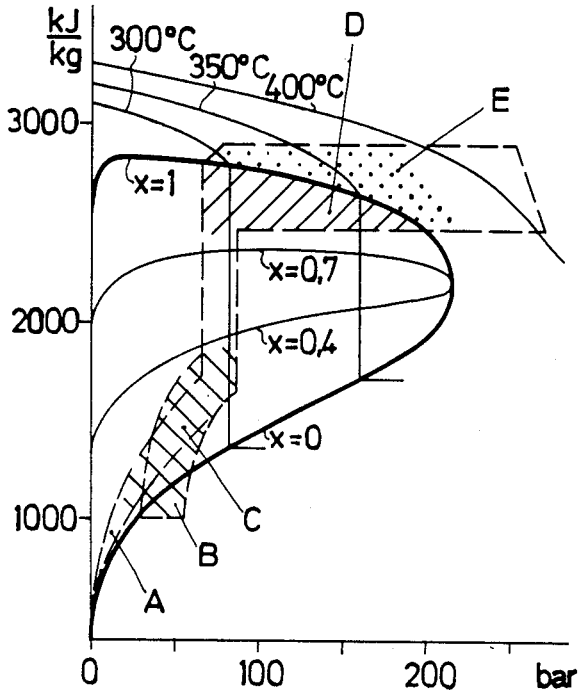

FIG. 1 shows the known pressure-enthalpy diagram for water/steam with a number of frequent working zones. A twophase zone extends between the lines X=0 and X=1; X denoting the proportion of steam, X=0 in the case of only water and X=1 in the case of only steam. During a cold start, the water-steam state moves roughly inside the zone A and during a start after about 8 hours shut-down this state extends approximately inside the zone B, zone C being common to A and B. In these operating zones, the proportion of water in the mixture is predominent and thence the pressure head losses in the tubes. This means that in zones A, B and C there is a risk that the flow through individual tubes will stagnate. The amount of steam is predominant in zone D and, hence, the frictional pressure losses. The main problem in this zone is with the distribution of the small amount of water. In zone E, where there is only steam, the steam must be distributed sufficiently as to render the temperature uniform. The phase distribution tank must therefore be able to satisfy the appropriate different objectives in all these very different working zones. The known tank operates successfully in only one of these zones, however, and its efficiency is poorer in the other zones.

Figure 2:
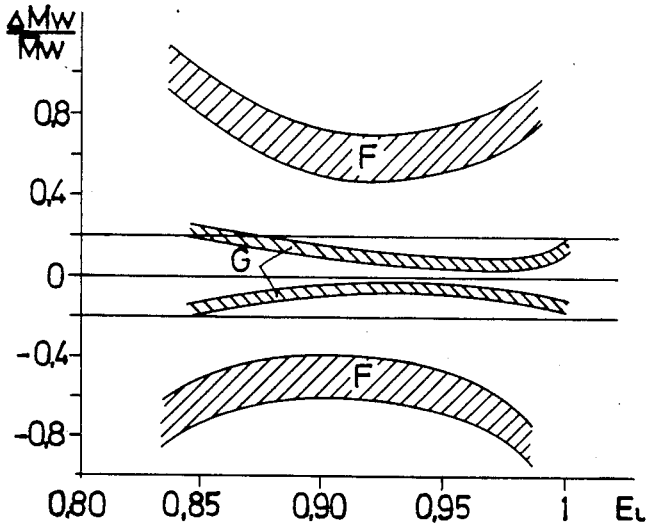

Experiments carried out with a water-air mixture impressively showed (see FIG. 2) the surprising effect of the principle of the invention. FIG. 2 shows the deviation of the relative water flow $\Delta Mw/\overline{M}w$ against the relative air flow $E_L$ at the start of the discharge conduits, where:

$\Delta Mw$ = deviation of mass flow of water at the start of the discharge conduits, in kg/s.

$\overline{M}w$ = average total mass flow of water at the start of the discharge conduits, in kg/s.

$E_L = V_L/(V_L + Vw)$ $V_L$ = total volumetric flow of air at the start of the discharge conduits, in $m^3/s$.

Vw = Total volumetric flow of water at start of the discharge conduits, in $m^3/s$.

Figure 3:
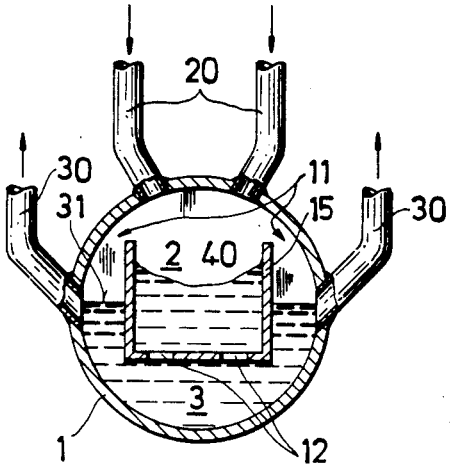
FIG. 3 illustrates a view taken on line III—III of FIG. 4.
Figure 4:
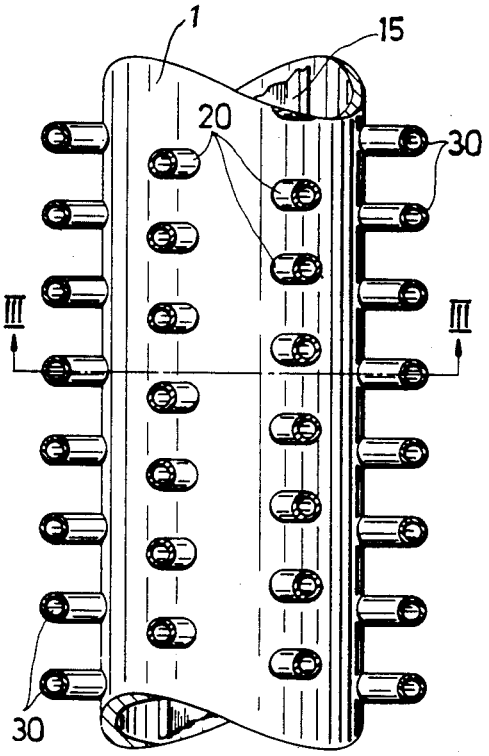
FIG. 4 illustrates a plan view of a phase distribution tank in the form of a header constructed in accordance with the invention.

The bands F show these deviations in a phase distribution tank in the form of a prior-art phase distribution header and the bands G show the corresponding deviations in the same header modified in accordance with features of the invention (e.g. as illustrated in FIGS. 3 and 4). Bands F and G cover the results of different measurements per $E_L$ value and thus show that the dispersions due to various interference factors are about four times greater in the prior art than in a phase distribution tank constructed in accordance with the invention, an additional proof of the advantages of the invention. In this series of experiments, the phase distribution tank in accordance with the invention was first embodied very roughly. Even better results can be expected from a careful design of the tank according to the invention.

Referring to FIGS. 3 and 4, the phase distribution tank for a gas-liquid mixture is formed as a horizontally disposed tube 1 which is closed at both ends by circular end plates 40 which are welded thereto to form a seal. In addition, a partition in the form of a U-shape trough 15 is disposed in the tank 1 and extends between and is welded to the two end plates 40.

The partition 15 divides the interior of the tank 1 into two chambers, i.e. an inlet chamber 2 which is substantially surrounded by the partition 15 and an outlet chamber 3 which surrounds the partition 15. As shown in FIG. 3, two gas passage apertures 11 are provided in a top zone of the partition 15, i.e. between the edges along the top zones of the vertical legs of the trough and the tank 1. Each of these apertures 11 serves for the passage of a gas phase from the inlet chamber 2 to the outlet chamber 3.

The partition 15 also has a plurality of liquid passage apertures 12 in a bottom zone, i.e. in the horizontal web of the trough which acts as a base of the inlet chamber 2. These apertures 12 serve for the passage of the liquid phase from the inlet chamber 2 to the outlet chamber 3.

As indicated in FIGS. 3 and 4, the tank 1 is provided with a plurality of rows of feed orifices and discharge orifices for a gas-liquid mixture. In addition, feed conduits 20 are connected to the respective orifices for feeding the gas-liquid mixture into the inlet chamber 2 while discharge conduits 30 are connected to the discharge orifices for discharging the gas-liquid mixture from the outlet chamber 3. The feed conduits 20 extend substantially vertically and lead into the inlet chamber 2 after being bent slightly towards the center of the circular cross section of the tank 1. The discharge conduits 30 also extend substantially vertically but are bent more sharply than the feed conduits 20 before communicating with the outlet chamber 3 in line with the center of the cross section of the tank 1. The feed and discharge conduits 20, 30, respectively, extend symmetrically of a vertical plane through the longitudinal axis of the tank 1 so that all the orifices of the feed conduits and the orifices of the discharge conduits are always at the same heights.

The number of feed conduits 20 is equal to the number of discharge conduits 30.

The phase distribution tank 1, for example, when used as a header operates as follows:

A mixture of a liquid and a gaseous phase flows through the feed conduits 20 and enters the inlet chamber 2. The two phases are separated from one another in the chamber 2 as a result of the deflection of the incoming mixture and the different specific gravities of the two phases, there being a generally intense turbulence in the inlet chamber 2. The separated gaseous phase escapes through the narrow gas passage apertures 11 into the outlet chamber 3 and is substantially still when flowing into the discharge conduits 30. The separated liquid phase, in turn, leaves the inlet chamber 2 through the liquid passage aperture 12 and collects in the outlet chamber 3, turbulence being prevented from being transmitted from the inlet chamber 2 to the outlet chamber 3 as a result of the extremely limited connection with the inlet chamber 2 and the relatively large mass of liquid in the outlet chamber.

A stable and uniformly distributed level 31 thus forms between the two phases in the outlet chamber 3. Also, with the gaseous phase flowing to a discharge conduit 30, a well-metered quantity of liquid escapes through each orifice. For a short period at the start of the operation, until sufficient liquid has collected in the outlet chamber 3 to reach the orifices to the discharge conduit 30, of course, only gaseous phase flows out of the tank 1. This time is usually very short. If, however, the amount of liquid phase is so small as not to reach the height of the orifices to the discharge conduits 30, the tank 1 operates solely as a liquid separator. If, on the other hand, there is a very large amount of liquid, the level 31 rises rapidly and with the increasing quantity of liquid a still sufficient amount of gaseous phase must leave the tank so that a stagnation of the mixture is prevented.

Experience shows that given a reasonable dimensioning of the various conduits and components of the phase distribution tank 1, the resulting state of operation is such that the amount of mixture leaving the tank is equal to the amount flowing into the tank whereby the liquid level 31 remains constant. In the event of any variation in the amount of liquid in the incoming mixture, the level 31 shifts and the proportion of liquid in the discharge conduits 30 changes accordingly. The actual function of the phase distribution tank is fulfilled in every case because the phase distribution is constant for a given state of operation and is the same for all the discharge conduits 30 irrespective of whether there is no liquid or only liquid flowing in the discharge conduits 30.

Of note, the phase distribution tank 1 behaves better than the prior-art phase distribution tank even in single-phase operation, e.g. operation with just steam in the zone E in FIG. 1, because the incoming steam is very well distributed on passing from the inlet chamber 2 to the outlet chamber 3 and has a uniform temperature in the outlet chamber 3.

Figure 5:
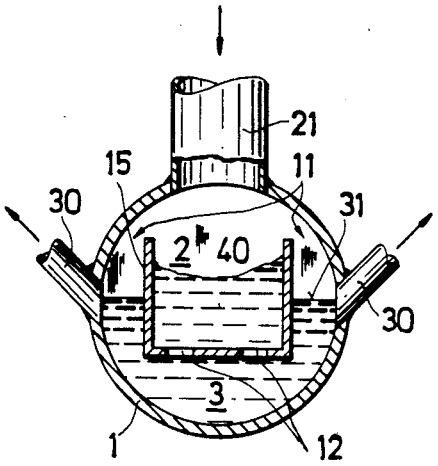
FIG. 5 illustrates a view taken on line V—V of FIG. 6.
Figure 6:
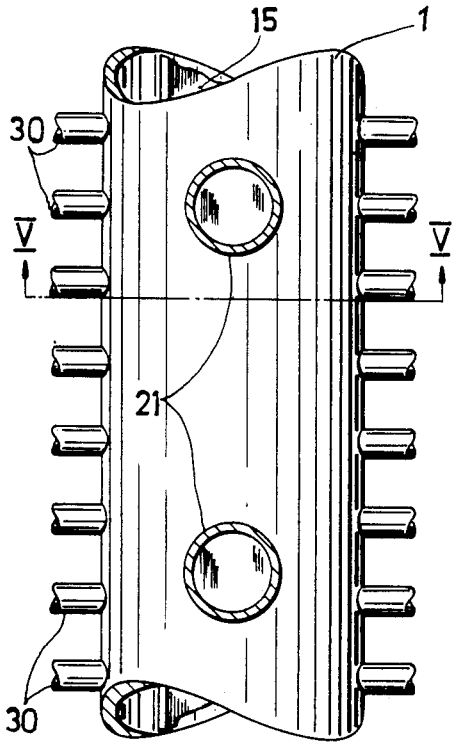
FIG. 6 illustrates a plan view of a modified phase distribution tank constructed in accordance with the invention having an unequal number of feed conduits and discharge conduits.

Referring to FIGS. 5 and 6 wherein like reference characters indicate like parts as above, the phase distribution tank may be constructed with an uneven number of feed conduits 21 relative to the discharge conduits 30. In this regard, the phase distribution tank 1 is provided with ten discharge conduits 30 for each feed conduit 21. The operation of the phase distribution tank 1 is otherwise as described above with respect to the embodiment of FIGS. 3 and 4.

Figure 7:
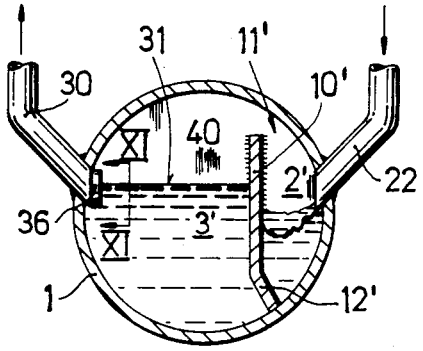
FIG. 7 illustrates a vertical sectional view through a further modified phase distribution tank constructed in accordance with the invention.

Referring to FIG. 7, the phase distribution tank 1 may be constructed so that a feed conduit 22 and a discharge conduit 30 extend symmetrically relative to a vertical plane through the longitudinal axis of the tank 1. As above, the tank 1 is in the form of a header and the conduits 22, 30 are identical to one another and are of an equal number.

As shown, a partition 10′ is disposed between an inlet chamber 2′ and an outlet chamber 3′ but in this case, consists solely of a piece of sheet metal which extends asymmetrically and vertically along the tank 1. The partition 10′ further has a strip which is slightly bent over in the bottom region through which liquid passage apertures 12′ are formed in the manner of round holes. The sheet metal partition 10′ is welded to the two end plates 40 and is spaced from the tank 1 at the top zone to form a gas passage aperture 11′.

The phase distribution tank of FIG. 7 operates in the same way as the embodiment illustrated in FIGS. 3 and 4.

Figure 11:
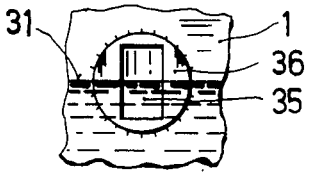
FIG. 11 illustrates a view taken on line XI—XI of FIG. 7.

Referring to FIG. 11, the discharge orifice to each discharge conduit 30 is provided with a cover 36 which is welded to the side wall of the tank. As indicated, each cover 36 is provided with a rectangular opening 35 so as to impart a rectangular shape to the discharge orifice with a pair of horizontal sides. The effect of the rectangular opening 35 is that the same liquid surface is always exposed to the gas flow irrespective of the liquid level 31 in the region of the orifice to the discharge conduit 30. Consequently, small fluctuations in liquid level due to vibrations or, for example, impacts have practically no effect on the phase distribution in the discharge conduit 30. Another advantage of the construction is that this region of the orifice may have a different cross-section from the corresponding discharge conduit 30 so that for the phase distribution a more favorable velocity of the mixture can be provided at that point. Of course, the openings may be other than rectangular, such as circular, square or polygonal.

Figure 8:
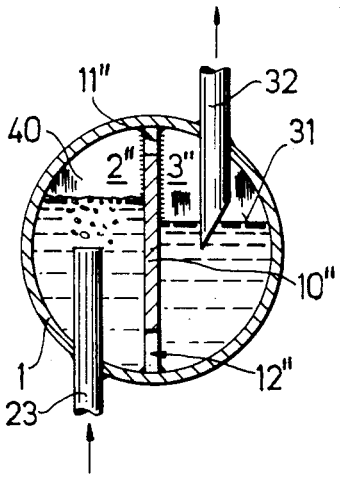
FIG. 8 illustrates a further modified phase distribution tank having a vertical partition in accordance with the invention.

Referring to FIG. 8 wherein like reference characters indicate like parts as above, the partition 10″ may be formed by a vertical metal sheet which is disposed symmetrically of the center of the tank, i.e. on the longitudinal axis of the tank 1, while being welded to the tank and to the end plates 40. As indicated, rectangular gas passage apertures 11″ and liquid gas passage apertures 12″ are cut out at the top and bottom along the edges of the partition 10″.

Feed conduits 23 extend vertically and pass through the wall of the tank 1 on one side of the partition 10″ so that the mixture enters from below and upwards in an inlet chamber 2″ with the orificies of the feed conduits 23 covered by the liquid phase in the inlet chamber 2″.

Discharge conduits 32 also extend vertically and pass through the wall of the tank 1 on the opposite side of the partition 10″ and extend to the liquid level 31 in the outlet chamber 3″. As indicated, an oblique cut is formed at the lower end of each discharge conduit 32 to form an orifice in the form of an inclined ellipse through which the departing gas phase of the mixture flows at different levels 31 and entrains the liquid phase in known manner. This type of construction is particularly advantageous when the mixture has a considerable proportion of liquid phase and flows at relatively low speed into the inlet chamber 2″. In this case, the gaseous phase can readily escape from the liquid phase in the region of the inlet chamber 2″.

Since the mixture leaving the feed conduit 23 is intercepted by the liquid phase in the inlet chamber 2″ and is distributed, liquid is not sprayed around the area of this inlet chamber 2″ and subsequent mixing of the separated phases is avoided. Otherwise this construction operates in the same way as those described hereinbefore.

Figure 9:
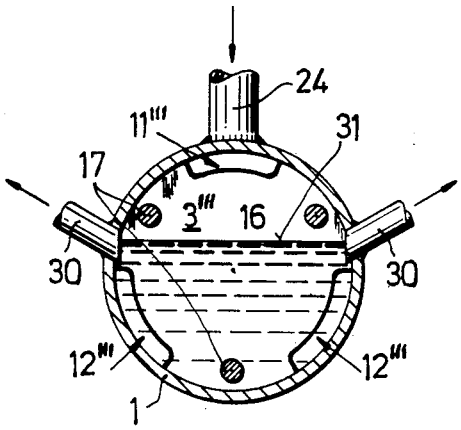
FIG. 9 illustrates a sectional view taken on line IX—IX of FIG. 10 of a still further modified phase distribution tank having vertical partitions in accordance with the invention.
Figure 10:
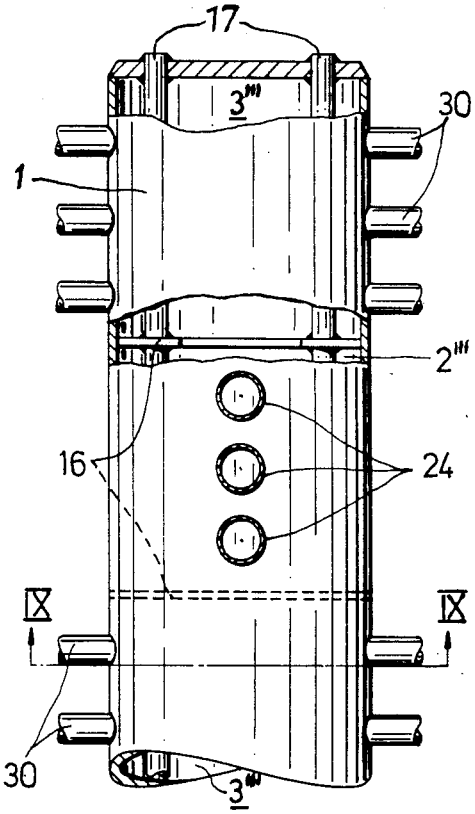
FIG. 10 illustrates a plan view of the tank of FIG. 9.

FIGS. 9 and 10 illustrate one example of the invention in which the tubular tank 1 is not divided longitudinally but perpendicularly thereto. In this case, various inlet chambers 2‴ and outlet chamers 3‴ are disposed seriatim and are separated from one another by disc-shaped partitions 16. The top zone of each partition 16 has a gas passage aperture 11‴ and the bottom region has two liquid passage apertures 12‴. Three rods 17 each made from a round bar extend along the phase distribution tank 1 and extend through the partitions 16 and through the end plates 40 and are welded in sealtight relationship to each plate 40, so that they are carried by the end plates 40 and, in turn, mount the partitions 16.

Feed conduits 24 extend vertically and lead, three per inlet chambers 2‴, into the top zone of the tank 1. Six discharge conduits 30 lead into each outlet chamber 3‴ symmetrically to a vertical plane through the longitudinal axis of the tank 1. This exemplified embodiment operates in the same way as the embodiments shown in FIGS. 3 and 4, 5 and 6 and 7.

The embodiments illustrated are only a few of the many posssible embodiments. The principle of the invention covers many other variants depending on the specific marginal conditions governing each individual problem. More particularly, the tubular form selected for the phase distribution tank 1 must not be regarded as compulsory. Although this shape is frequently very advantageous, it is in many cases very advantageously replaced by other shapes.

In the event of high mixture inlet speeds, the partition in each of the examples illustrated can additionally be strengthened against vibration, both by connections between the partitions and the tank wall and by a choice of thicker gauge metal for the partition material. None of these steps interferes with the serviceability of tha tanks.

Special production materials can be used in the case of corrosive media and/or very high temperatures.

The term "partition" as used herein denotes not only a smooth unitary sheet-metal wall but also, for example, a corrugated or zig-zag wall. Alternatively, the partition may be in the form of a flat static mixer element. All that is required in the case of this embodiment is for the stable liquid level in the outlet chamber to be adequately protected from the turbulence in the inlet chamber.

Invention thus provides a phase distribution tank which is of relatively simple construction and which can operate in various zones or states of a gas-liquid mixture. Further, the invention provides a phase distribution tank which provides an efficient means of uniformly mixing the phases of a gas-liquid mixture delivered thereto prior to distribution to other places.

What is claimed is:

1. A phase distribution tank having a horizontally disposed tube having an end plate closing each end;

A longitudinally and horizontally extending U-shaped trough in said tube connected to each end plate to separate an upper inlet chamber within said trough from a lower outlet chamber about said trough;

at least two feed conduits for feeding a gasliquid mixture into said inlet chamber;

at least two discharge conduits for discharging a gas-liquid mixture from said outlet chamber with a level of liquid in said outlet chamber intersecting an orifice of each said discharge conduit;

at least one gas passage aperture between a top zone of said trough and said tank for passage of the gas phase of the mixture from said inlet chamber to said outlet chamber; and at least one liquid passage aperture in a bottom zone of said trough for passage of the liquid phase of the mixture from said inlet chamber to said outlet chamber whereby said apertures are disposed to eliminate any effect of turbulence in said inlet chamber on the level of the liquid in said outlet chamber.

2. A phase distribution tank as set forth in claim 1 wherein said discharge conduits communicate with said outlet chamber in line with the center of the cross section of said tank.

3. A phase distribution tank as set forth in claim 1 wherein said feed conduits are disposed symmetrically of a vertical plane through a longitudinal axis of said tank and wherein said discharge conduits are disposed symmetrically of said vertical plane.

* * * * *